US009447570B1

(12) United States Patent
Schuster et al.

(10) Patent No.: US 9,447,570 B1
(45) Date of Patent: Sep. 20, 2016

(54) DUAL FLUSH HANDLE CONTROL

(75) Inventors: Michael J. Schuster, Joliet, IL (US); Douglas C. Saunders, Plainfield, IL (US); Duston E. A. Stutzman, Plainfield, IL (US)

(73) Assignee: Danco, Inc., Irving, TX (US)

( * ) Notice: Subject to any disclaimer, the term of this patent is extended or adjusted under 35 U.S.C. 154(b) by 1025 days.

(21) Appl. No.: 13/272,778

(22) Filed: Oct. 13, 2011

Related U.S. Application Data

(60) Provisional application No. 61/393,527, filed on Oct. 15, 2010.

(51) Int. Cl.
*E03D 5/09* (2006.01)
*E03D 5/094* (2006.01)

(52) U.S. Cl.
CPC ..... *E03D 5/094* (2013.01); *E03D 5/09* (2013.01)

(58) Field of Classification Search
CPC ..... E03D 5/09; E03D 5/092
USPC ..... 4/405, 324–325
See application file for complete search history.

(56) References Cited

U.S. PATENT DOCUMENTS

| | | | | | |
|---|---|---|---|---|---|
| 4,305,163 | A | | 12/1981 | Raz | |
| 4,750,220 | A | * | 6/1988 | Baumann | 4/324 |
| 5,117,513 | A | * | 6/1992 | Burrowes | 4/324 |
| 5,140,712 | A | * | 8/1992 | Wang-On | 4/325 |
| 5,301,373 | A | | 4/1994 | Hull et al. | |
| 5,375,268 | A | * | 12/1994 | Chen | 4/325 |
| 5,396,665 | A | * | 3/1995 | Raz et al. | 4/325 |
| 5,491,848 | A | * | 2/1996 | Wang | 4/405 |
| 5,680,659 | A | * | 10/1997 | Gessaman | 4/325 |
| 6,263,520 | B1 | * | 7/2001 | Song | 4/325 |
| 7,062,801 | B2 | * | 6/2006 | Oliver | 4/325 |
| 2007/0163034 | A1 | | 7/2007 | Ogen | |
| 2010/0132104 | A1 | * | 6/2010 | Csiki | 4/324 |
| 2011/0203042 | A1 | | 8/2011 | Roberts et al. | |
| 2013/0191981 | A1 | | 8/2013 | Schuster et al. | |

* cited by examiner

*Primary Examiner* — Janie Loeppke
(74) *Attorney, Agent, or Firm* — Thomas | Horstemeyer, LLP

(57) ABSTRACT

Disclosed are various embodiments for a dual flush handle control. A rotary handle assembly for a dual flush toilet system includes a flush stop, a handle lever, a handle switch, and a restriction arm. The handle switch is configured to extend through a surface of the handle lever from an unextended position to an extended position. The restriction arm is configured to engage the handle switch at a proximal end and control engagement with the flush stop to restrict rotation of the handle lever based upon the position of the handle switch.

16 Claims, 19 Drawing Sheets

DUAL FLUSH HANDLE CONTROL

CROSS REFERENCE TO RELATED APPLICATIONS

This application claims priority to U.S. provisional application entitled "Dual Flush Handle Control" having application No. 61/393,527, filed Oct. 15, 2010, the entirety of which is hereby incorporated by reference.

BACKGROUND

Most dual flush toilet systems are provided as a package including a dual flush assembly and activation device to initiate operation of the dual flush assembly in one of the dual flush modes. In many instances, the activation control may not be preferred by the customer.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
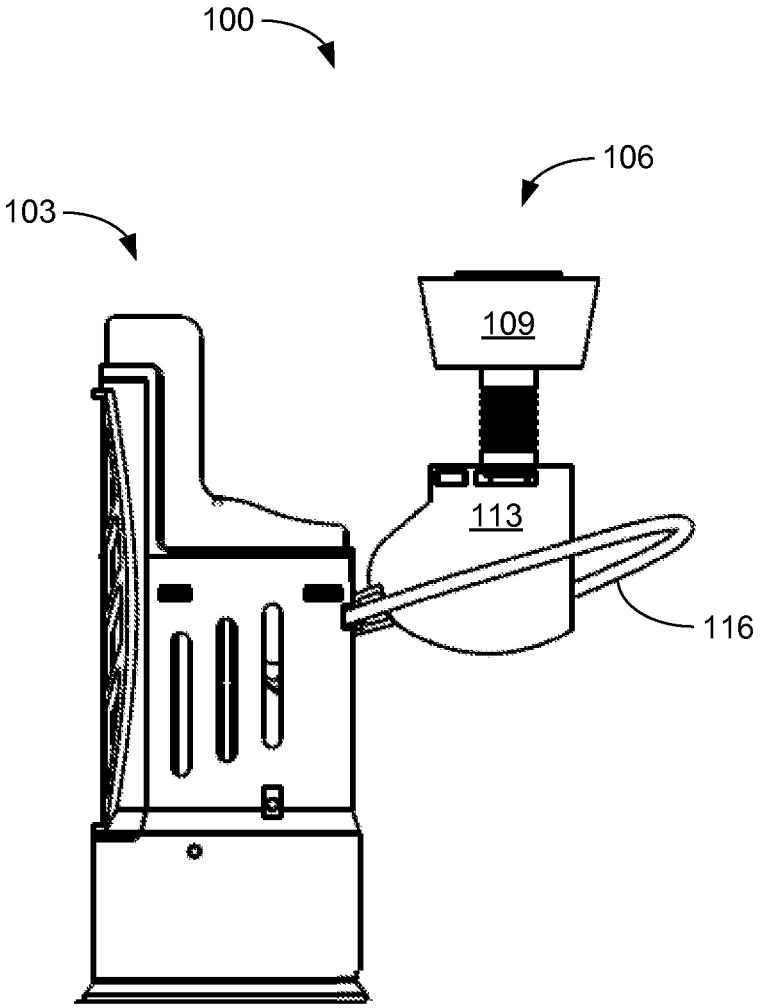
FIG. 1 is a drawing of a dual flush toilet system with push button activation of a dual flush assembly according to various embodiments of the disclosure.

With reference to FIG. 1, shown is a dual flush toilet system 100 including a dual flush assembly 103 and an activation assembly 106 to initiate operation of the dual flush assembly 103 in one of the dual flush modes: quick flush for liquids and full flush for solids. In the embodiment of FIG. 1, the activation assembly 106 includes a push button assembly 109 that is detachably connected to an actuation control box 113. The actuation control box 113 is in communication with the dual flush assembly 103 through a cable assembly 116, which is directly connected to the actuation control box 113 and the body of the dual flush assembly 103.

Referring next to FIGS. 2A-2F, the operation of the activation assembly 106 is illustrated. The push button assembly 109 is detachably connected to the actuation control box 113 through a shaft extension 203, which is threaded to mount the push button assembly 109 to the tank of the toilet with a nut. In the embodiment of FIGS. 2A-2F, the end 206 of the shaft extension 203 is engaged with the actuation control box 113 by a spring-loaded clip assembly 209. By pressing the end of clip assembly 209, the push button assembly 109 may be detached from the actuation control box 113. The push button assembly 109 includes a first button 213 for activation of the quick flush mode with a reduced amount of water usage and a second button 216 for activation of the full flush mode using the standard amount of water.

Figure 2A:
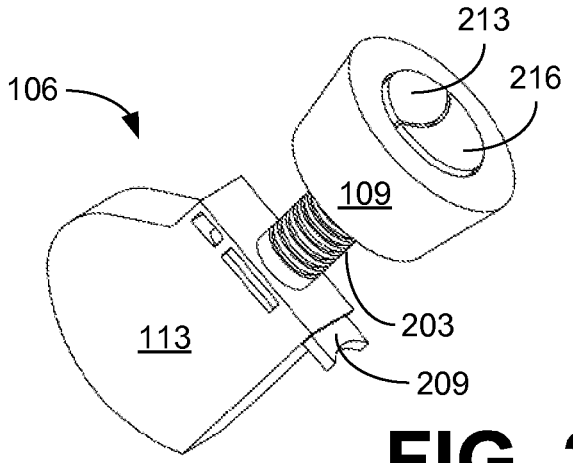
FIGS. 2A-2F are drawings that provide various views of an activation assembly for push button activation of the dual flush assembly of FIG. 1 according to various embodiments of the disclosure.
Figure 2B:
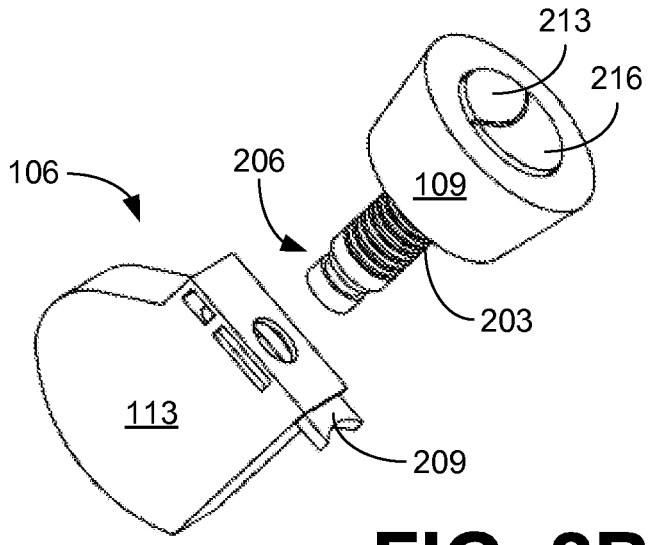
Figure 2C:
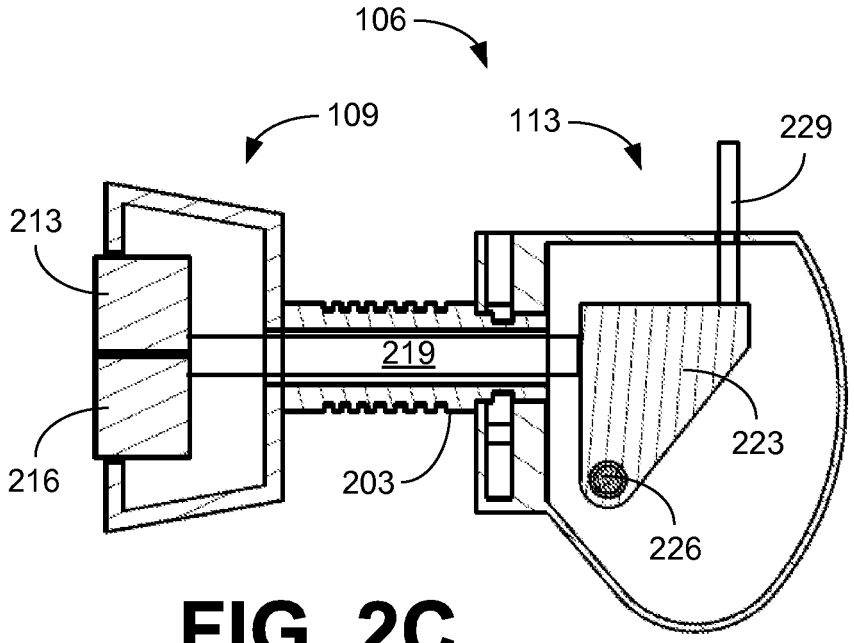
Figure 2D:
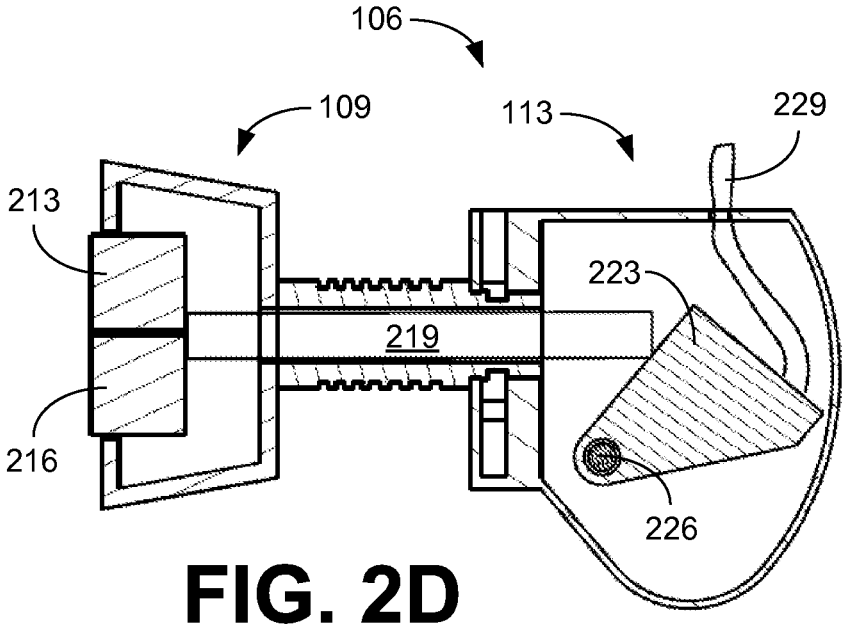
Figure 2E:
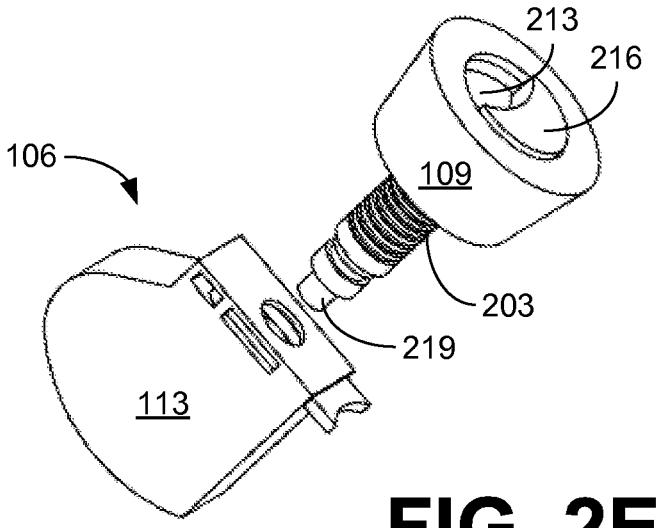
Figure 2F:
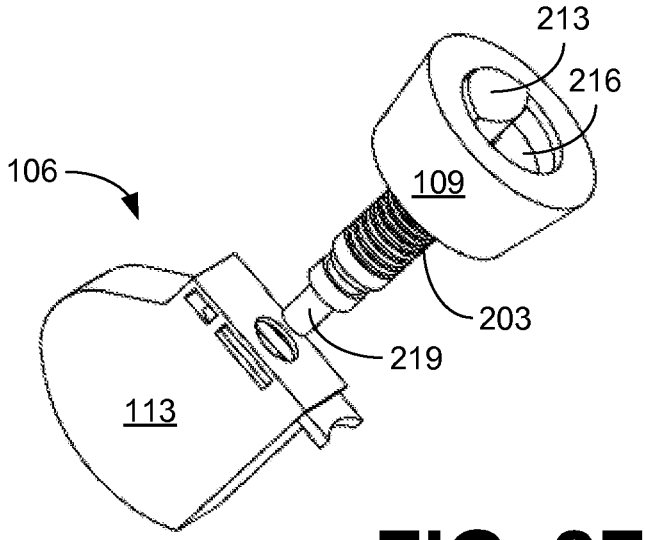

FIG. 2C illustrates a cross-sectional view of the activation assembly 106 of FIG. 2A. FIGS. 2A and 2C show the actuation control box 113 in a neutral position without buttons 213 or 216 depressed. Depressing one of the buttons 213 or 216 extends a plunger 219 from the end of the shaft extension 203 into the actuation control box 113. In the exemplary embodiment of FIGS. 2C-D, extension of plunger 219 causes a cam 223 to rotate about a fixed point 226, retracting a cable 229 into cable assembly 116 of FIG. 1. In this way, linear motion of the plunger 219 is converted into linear motion of cable 229 in cable assembly 116. Depressing the first "quick flush" button 213 extends the plunger 219 to a predetermined intermediate position as illustrated in FIG. 2E, while depressing the second "full flush" button 216 fully extends the plunger 219 as depicted in FIGS. 2B and 2F. When the plunger 219 is retracted after the desired flush is initiated, cam 223 and cable 229 return to the neutral position depicted in FIG. 2C.

Figure 3A:
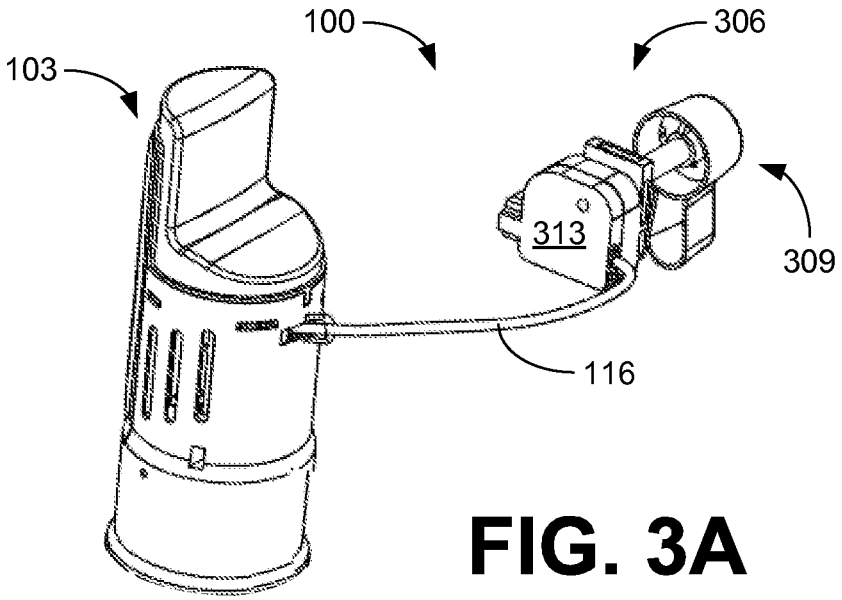
FIGS. 3A-3G are drawings of a dual flush toilet system with rotational activation of the dual flush assembly of FIG. 1 according to various embodiments of the disclosure.

With reference to FIGS. 3A-3G, shown is a dual flush toilet system 100 including a dual flush assembly 103 and an activation assembly 306 to initiate operation of the dual flush assembly 103 in one of the dual flush modes: quick flush for liquids and full flush for solids. In the embodiment of FIG. 3A, the activation assembly 306 includes a rotary handle assembly 309 that is detachably connected to an actuation control box 313. The exemplary actuation control box 313 is in communication with the dual flush assembly 103 through a cable assembly 116, which is connected to the actuation control box 313 and the body of the dual flush assembly 103.

Figure 3B:
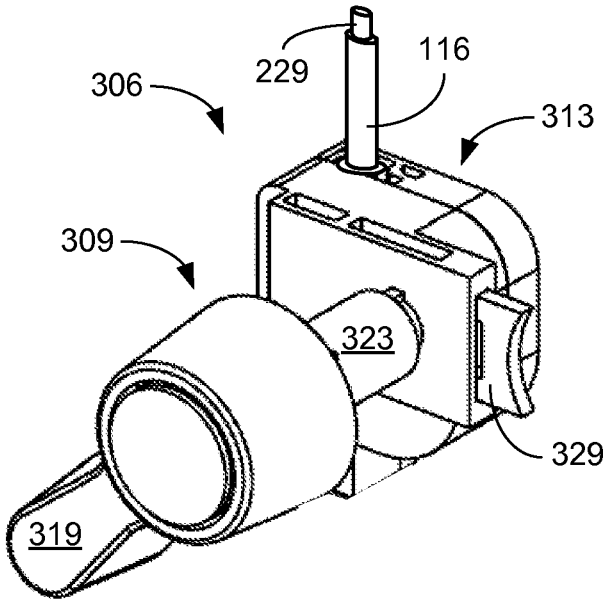

As illustrated in FIG. 3B, the rotary handle assembly 309 includes a handle lever 319, a mounting sleeve 323 and a shaft 326 (FIG. 3C), which extends through the mounting sleeve 323. The rotary handle assembly 309 is detachably connected to actuation control box 313. In the embodiment of FIGS. 3A-3G, the end of the mounting sleeve 323 is engaged with the actuation control box 313 by a spring-loaded clip assembly 329. By pressing the end of clip assembly 329, the rotary handle assembly 309 may be detached from the actuation control box 313.

Figure 3C:
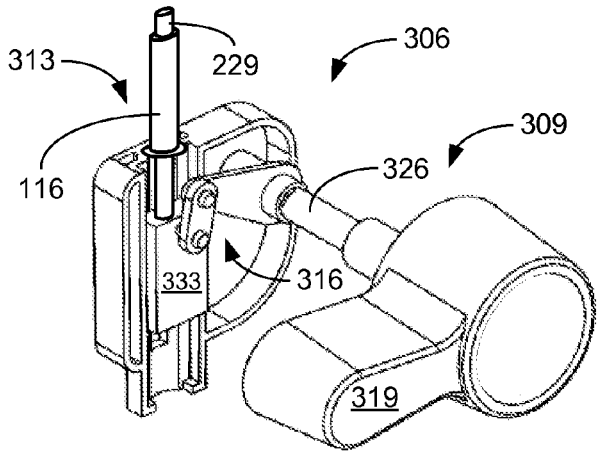

FIG. 3C provides a cross-sectional view of the actuation control box 313. Rotational motion of rotary handle assembly 309 is converted into linear motion of cable 229 in cable assembly 116 by the actuation control box 313 through linkage assembly 316 and piston 333, which is coupled to cable 229 and constrained within a guide channel. Full rotation of the rotary handle assembly 309 initiates a "full flush" of the dual flush assembly 103, while rotation of the rotary handle assembly 309 to only an intermediate position initiates a "quick flush" of the dual flush assembly 103. While the translation of rotational motion to linear motion by the exemplary actuation control box 313 is presented in terms of the linkage assembly 316 coupled to piston 333, other means for translation of rotational motion to linear motion may also be utilized within the actuation control box 313.

Figure 3D:
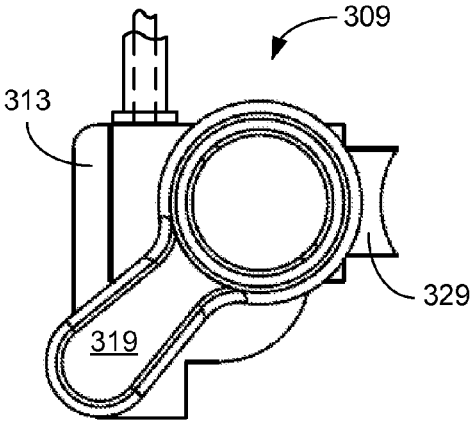
Figure 3E:
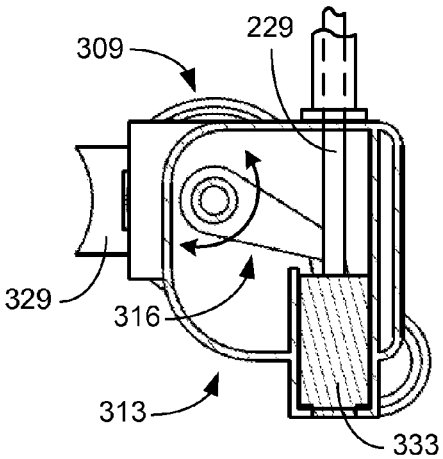

The operation of the exemplary activation assembly 306 with a rotary handle assembly 309 is now discussed with reference next to FIGS. 3D-3G. When the actuation control box 313 is in a neutral position (FIG. 3C), the handle lever 319 is in a horizontal position with cable 229 partially retracted into the actuation control box 313. Full rotation of the rotary handle assembly 309, as depicted in FIGS. 3D-3E, causes cable 229 to retract into the actuation control box 313, initiating a "full flush" of the dual flush assembly 103.

Figure 3F:
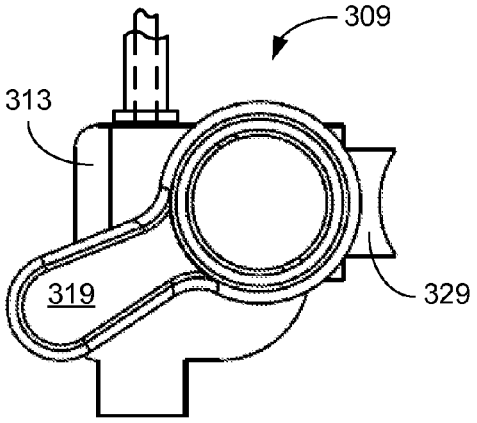
Figure 3G:
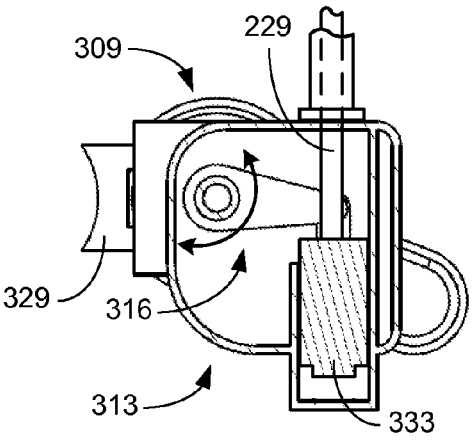

Restricting the rotation of rotary handle assembly 309, and thus retraction of cable 229, to an intermediate position that provides for a "quick flush" of the dual flush assembly 103. FIGS. 3F-3G illustrate operation of the rotary handle assembly 309 with restricted rotation. As depicted in FIG. 3G, rotation of the handle lever 319 is translated from the shaft 326 through the linage assembly 316 and piston 333 to linear movement of cable 229 until the intermediate position is reached.

It should be noted that, while the rotary handle assembly 309 is described in relation to an actuation control box 313, the rotary handle assembly 309 may be utilized in other applications that require a restricted rotational motion without the use of the actuation control box 313. For example, if a toilet utilizes a flapper that is lifted by a chain, the amount of flapper lift may be restricted by the rotary handle assembly 309. In one embodiment, a lever arm may engage with the end of the shaft 326 to lift the chain. Alternatively, rotation of the rotary handle assembly 309 may be sensed (either mechanically or electrically) to control an application.

Figure 4A:
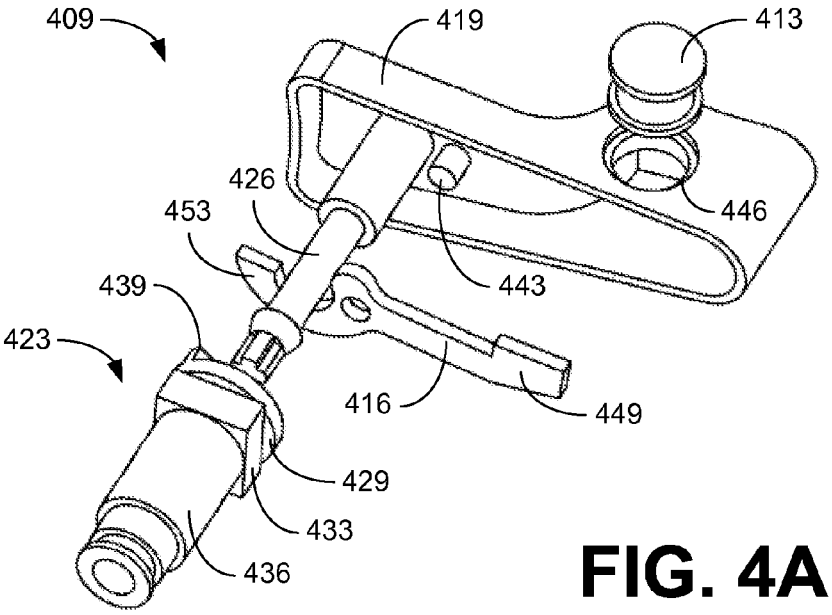
FIGS. 4A-4E are drawings that provide various views of an embodiment of the rotary handle assembly that can be utilized in the activation assembly of FIGS. 3A-3G according to various embodiments of the disclosure.

Referring next to FIGS. 4A-4E, shown are views of an exemplary rotary handle assembly 409 that restricts rotation during operation of the dual flush assembly 103. FIG. 4A provides exploded views of the handle assembly 409, including handle lever 419, handle switch 413 (e.g., a button, a toggle, etc.), restriction arm 416, and mounting sleeve 423. Handle lever 419 includes a shaft 426 that, when assembled, extends through the center of mounting sleeve 423 and engages with a linkage assembly 316 (FIG. 3C) of an actuation control box 313.

Mounting sleeve 423 includes a tank shoulder 429, an alignment element 433, and a shaft sleeve 436. When mounting sleeve 423 is inserted through an opening in the wall of a toilet tank 403 (FIGS. 4C-4E), tank shoulder 429 engages with the outer surface of the tank 403 and alignment element 433 engages with the opening to maintain the orientation and prevent rotation of the mounting sleeve 423 within the wall of the tank 403. In some embodiments, shaft sleeve 436 may be threaded to receive a nut (not shown) or other fastener to hold the mounting sleeve 423 in position within the wall of the tank 403. The tank shoulder 429 also includes a flush stop 439 to limit the rotation of the handle lever 419 during operation. The end of the mounting sleeve 423 is configured to engaged with the actuation control box 313 by a spring-loaded clip assembly 329 (FIG. 3B). One or more alignment tab may be included on the end of the mounting sleeve 423 to ensure proper alignment with the actuation control box 313.

Figure 4B:
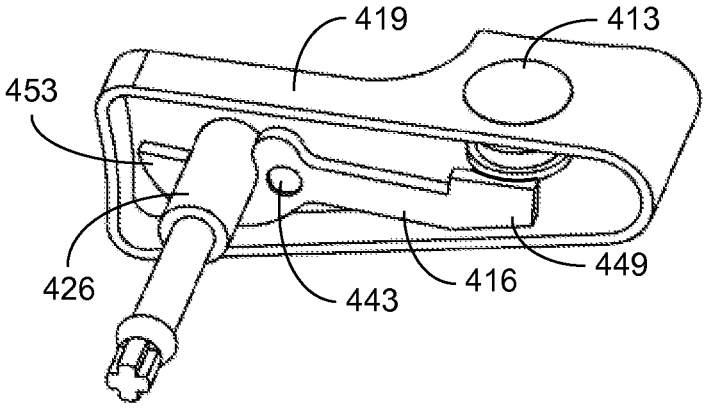

When assembled in the handle lever 419, as illustrated in FIG. 4B, the restriction arm 416 pivots about a pin 443. In the embodiment of FIG. 4A-4E, the handle switch 413 is a button that extends through an opening 446 in a first or "top" surface (as oriented in FIG. 4B) of the handle lever 419 and engages with a proximal end 449 of the restriction arm 416. In some embodiments, the contact surface of the proximal end 449 of the restriction arm 416 may include an extended (or widened) surface to improve engagement with the handle switch 413. A distal end 453 of the restriction arm 416 extends around the shaft 426.

Figure 4C:
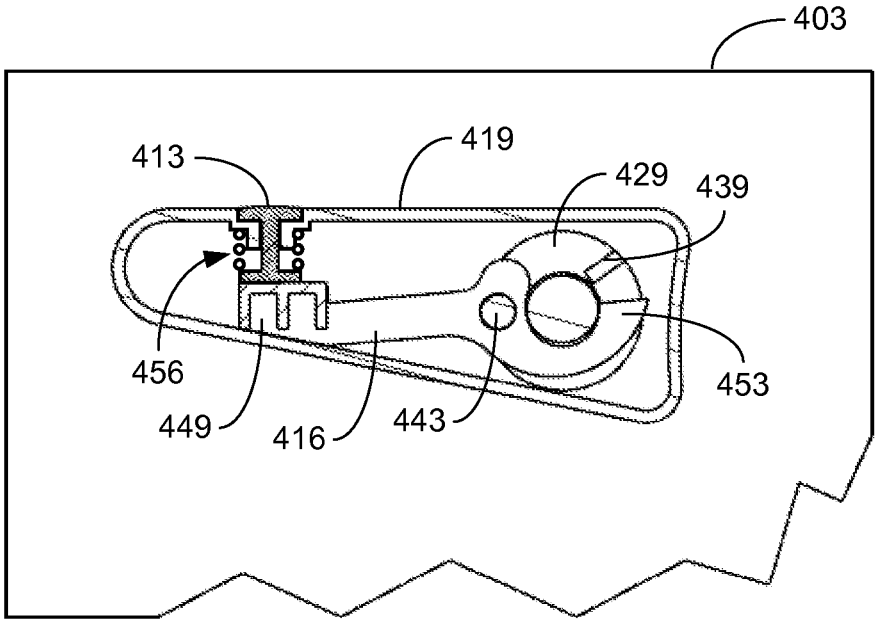
Figure 4D:
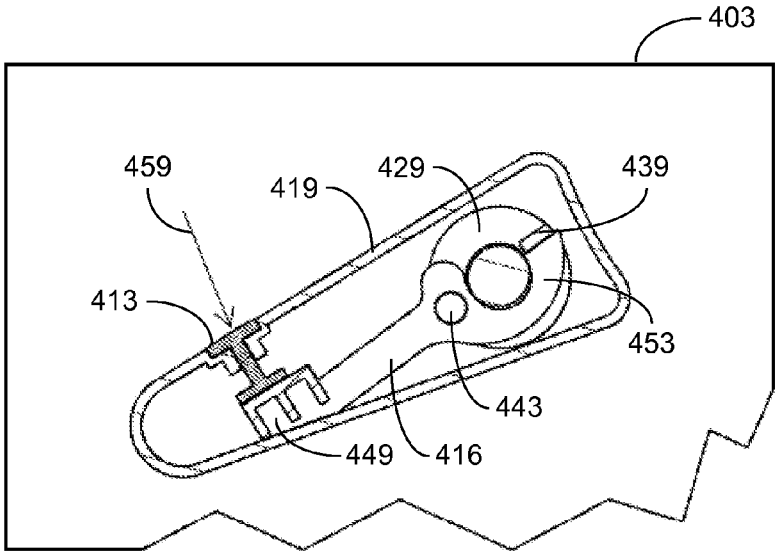
Figure 4E:
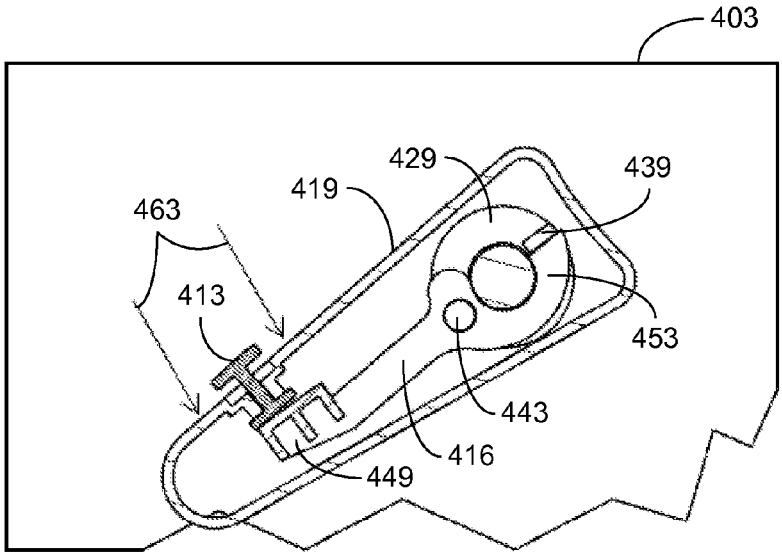

The operation of an exemplary activation assembly 306 utilizing the rotary handle assembly 409 is now discussed with reference next to FIGS. 4C-4E. FIGS. 4C-4E provide cross-sectional views of the rotary handle assembly 409 with the activation assembly 306 mounted in a wall of a toilet tank 403. When the actuation control box 313 is in a neutral position (FIG. 3C), the handle lever 419 is in a horizontal position as depicted in FIG. 4C. In the neutral position, handle switch 413 is retracted into the handle lever 419. In some embodiments, a spring mechanism 456 or other appropriate means may be used to retract the handle switch 413 into the handle lever 419. The spring mechanism 456 may be located about the handle switch 413 or at another location along the restriction arm 416. The proximal end 449 is adjacent to the "bottom" side opposite the first surface of the handle lever 419 as illustrated in FIG. 4C and cable 229 (FIG. 3C) is partially retracted into the actuation control box 313. While the orientation of the activation assembly 306 including the rotary handle assembly in FIGS. 4C-4E is discussed in terms of "top" and "bottom," it is understood that variations in orientation of the activation assembly 306 are equally applicable to the present disclosure.

To initiate a "quick flush" of the dual flush assembly 103 (FIG. 1), pressure 459 is applied to handle switch 413 as illustrated in FIG. 4D. The "downward" pressure 459 is transferred through the handle switch 413 and proximal end 453 of the restriction arm 416 to the "bottom" side of the handle lever 419 producing rotation of the handle lever 419, which is translated from the shaft 426 through the linage assembly 316 and piston 333 (FIGS. 3F-3G) to linear movement of cable 229 until the intermediate position is reached. The pressure 459 also engages handle switch 413 with the proximal end 449 of the restriction arm 416. When the rotary handle assembly 409 reaches the intermediate position, the distal end 453 of the restriction arm 416 engages with the flush stop 439. The pressure 459 on handle switch 413 prevents further rotation of the restriction arm 416 and the handle lever 419. Upon initiation of the "quick flush," pressure 459 may be removed and the rotary handle assembly 409 is allowed to return to the original neutral position of FIG. 4C.

A "full flush" of the dual flush assembly 103 (FIG. 1) can be initiated by applying pressure 463 to the handle lever 419 as illustrated in FIG. 4E. The "downward" pressure 463 produces rotation of the handle lever 419, which is translated from the shaft 426 through the linage assembly 316 and piston 333 (FIGS. 3F-3G) to linear movement of cable 229 until the intermediate position is reached. When the rotary handle assembly 409 reaches the intermediate position, the distal end 453 of the restriction arm 416 engages with the flush stop 439. Without pressure 459 being applied to the handle switch 413, restriction arm 416 pivots about pin 443 causing handle switch 413 to extend from the "top" surface of the handle lever 419. The extension of handle switch 413 allows the rotary handle assembly 409 to rotate to the full rotation position as depicted in FIGS. 3D-3E. The additional rotation may be in the range of about 8 to about 15 degrees. In some embodiments, about 10 degrees of additional rotation is allowed. Further rotation of the restriction arm 416 and the handle lever 419 is prevented when the handle switch 413 is fully extended by the proximal end 449 of the restriction arm 416 pressing against the handle switch 413, which is engaged with the "top" surface of the handle lever 419. Upon initiation of the "full flush," pressure 463 may be removed and the rotary handle assembly 409 is allowed to return to the original neutral position of FIG. 4C.

Figure 5:
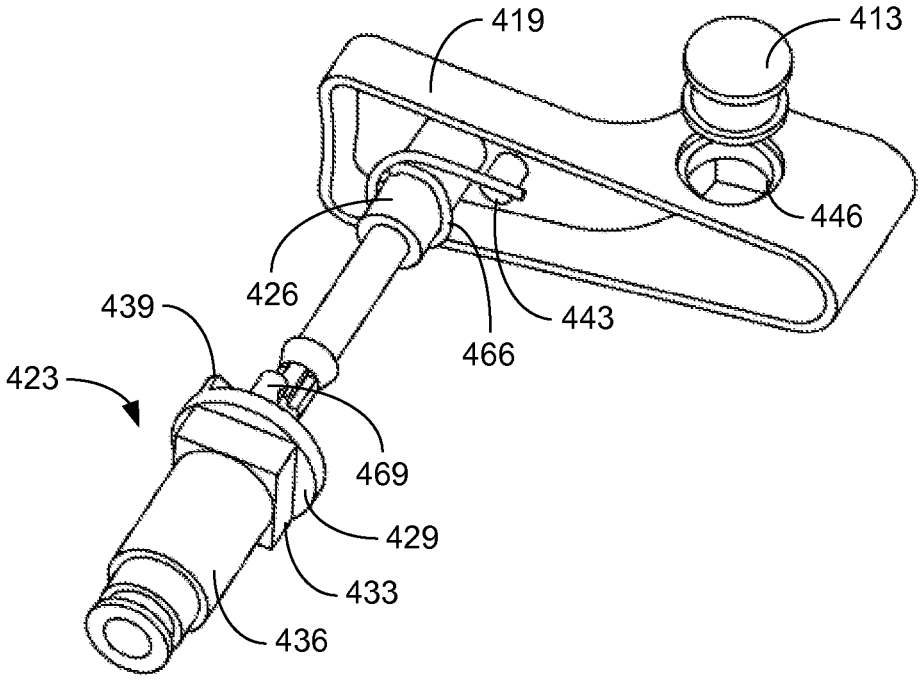
FIG. 5 is a drawing that provides various views of the handle lever assembly of FIGS. 4A-4E including a spring mechanism to return to the rotary handle assembly to the neutral position according to various embodiments of the disclosure.
Figure 5:
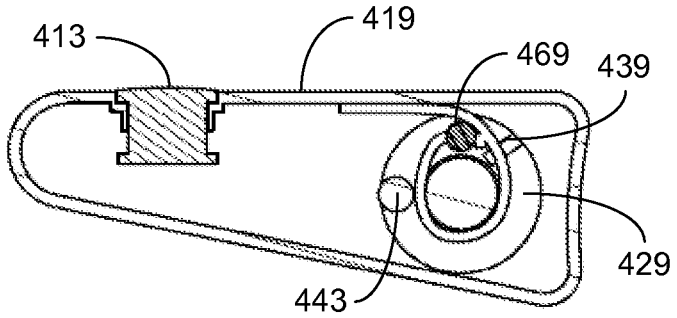

In some embodiments, completion of the selected flush by the dual flush assembly 103 (FIG. 1) returns cable 229 to its original position, extracting the retracted cable 229 from the actuation control box 313 (FIG. 3C) and restoring the rotary handle assembly 409 to the original neutral position of FIG. 4C. In other embodiments, a spring 466 may be utilized to restore the rotary handle assembly 409 to the original neutral position of FIG. 4C. In the exemplary embodiment of FIG. 5, spring 466 is wrapped around shaft 426. One or more fixing tabs 469 on the tank shoulder 429 secures spring 466 in position when the shaft 426 extends through the mounting sleeve 323. When the "downward" pressure 459/463 is removed from the rotary handle assembly 409, spring pressure applied to the first or "top" surface of the handle lever 419 restores the rotary handle assembly 409 to the neutral position.

Referring next to FIGS. 6A-6E, shown are cross-sectional views of another exemplary embodiment of a rotary handle assembly that restricts rotation during operation of the dual flush assembly 103 (FIG. 1). The handle assembly includes a handle lever 619, handle switch 613 (e.g., a button, a toggle, etc.), and restriction arm 616. The handle lever 619 includes a shaft (see, e.g., FIG. 4A) that, when assembled, extends through the center of a mounting sleeve and engages with a linkage assembly 316 (FIG. 3C) of an actuation control box 313. The mounting sleeve includes a tank shoulder 629 and an alignment element 633. When the mounting sleeve is inserted through an opening in the wall of a toilet tank 403, tank shoulder 629 engages with the outer surface of the tank 403 and alignment element 633 engages with the opening to maintain the orientation and prevent rotation of the mounting sleeve within the wall of the tank 403. The tank shoulder 629 also includes a flush stop 639 to limit the rotation of the handle lever 619 during operation.

Figure 6A:
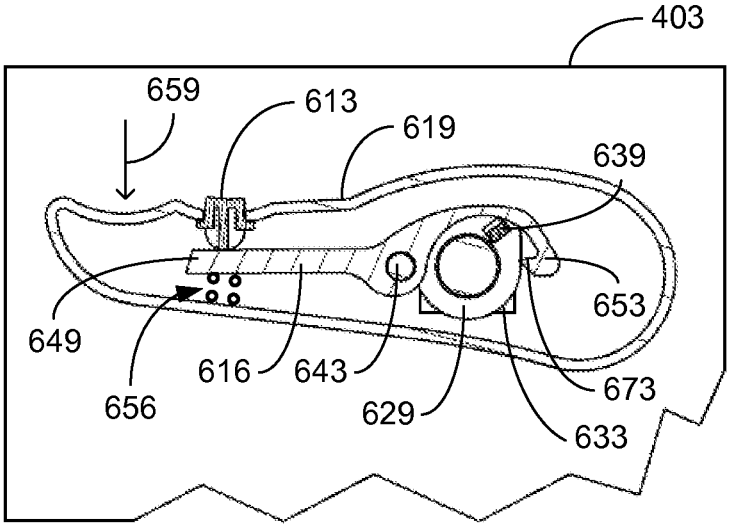
FIGS. 6A-6E are drawings that provide various views of a second embodiment of the rotary handle assembly that can be utilized in the activation assembly of FIGS. 3A-3G according to various embodiments of the disclosure.

When assembled in the handle lever 619, as illustrated in FIG. 6A, the restriction arm 616 pivots about a pin 643. In the embodiment of FIGS. 6A-6E, the handle switch 613 is a button that extends through an opening in a first or "top" surface (as oriented in FIG. 6A) of the handle lever 619 and engages with a proximal end 649 of the restriction arm 616. In some embodiments, the contact surface of the proximal end 649 of the restriction arm 616 may include an extended (or widened) surface to improve engagement with the handle switch 613. A distal end 653 of the restriction arm 616 extends around the shaft. A latching surface 673 is included at the inside of the distal end 653 of the restriction arm 616.

In the embodiment of FIGS. 6A-6E, the "top" surface of handle lever 619 is contoured with a first depression at the distal end of the handle lever 619. A second depression, in the "top" surface of the handle lever 619 adjacent to the first depression, includes the opening for the handle switch 613. While not necessary for operation of the rotary handle assembly of FIGS. 6A-6E, the contour depressions aid in finger alignment on the handle lever 619 when applying force to initiate a "quick flush" or a "full flush" of the toilet.

The operation of an exemplary activation assembly 306 utilizing the rotary handle assembly of FIGS. 6A-6E is now discussed. FIGS. 6A-6E provide cross-sectional views of the rotary handle assembly mounted in a wall of a toilet tank 403. When the actuation control box 313 is in a neutral position (FIG. 3C), the handle lever 619 is in a horizontal position as depicted in FIG. 6A. In the neutral position, handle switch 613 extends from the handle lever 619. In some embodiments, a spring mechanism 656 or other appropriate means may be used to extend the handle switch 613 out from the handle lever 619. In some embodiments, the spring mechanism 656 is located "below" the restriction arm 616 opposite the handle switch 613 as illustrated in FIG. 6A. Other spring mechanism locations along the restriction arm 616 may also be possible. While the orientation of the activation assembly 306 including the rotary handle assembly in FIGS. 6A-6F is discussed in terms of "top" and "bottom," it is understood that variations in orientation of the activation assembly 306 are equally applicable to the present disclosure.

Figure 6B:
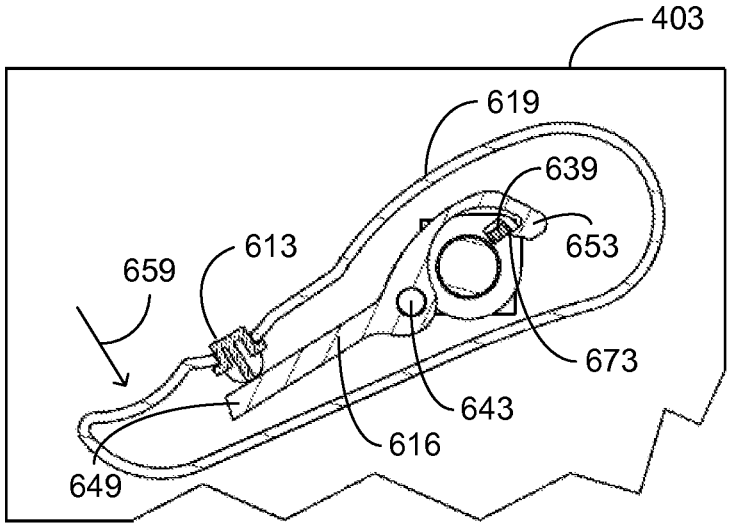

To initiate a "quick flush" of the dual flush assembly 103 (FIG. 1), pressure 659 is applied to the distal end (e.g., in the first depression) of the handle lever 619 as illustrated in FIG. 6A. The "downward" pressure 659 produces rotation of the handle lever 619, which is translated through the shaft to the linage assembly 316 and piston 333 (FIGS. 3F-3G) to linear movement of cable 229 until the intermediate position is reached. The pressure 659 is also transferred through the handle lever 619 and handle switch 613 to the proximal end 649 of the restriction arm 616. When the rotary handle assembly reaches the intermediate position, the latching surface 673 at the distal end 653 of the restriction arm 616 engages with the flush stop 639 as illustrated in FIG. 6B. The engagement prevents further rotation of the restriction arm 616 and the handle lever 619. Upon initiation of the "quick flush," pressure 659 may be removed and the rotary handle assembly is allowed to return to the original neutral position of FIG. 6A.

Figure 6C:
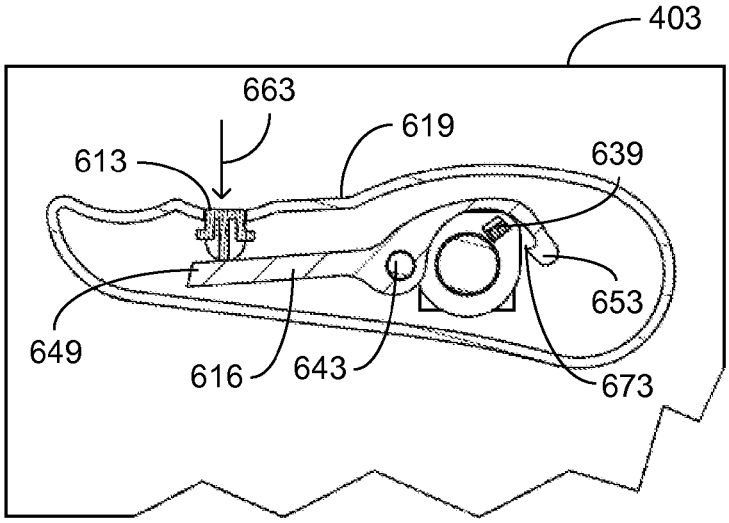
Figure 6D:
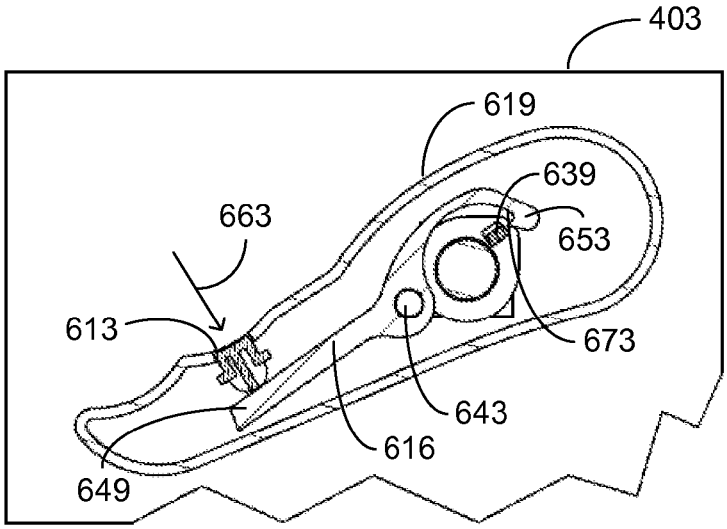
Figure 6E:
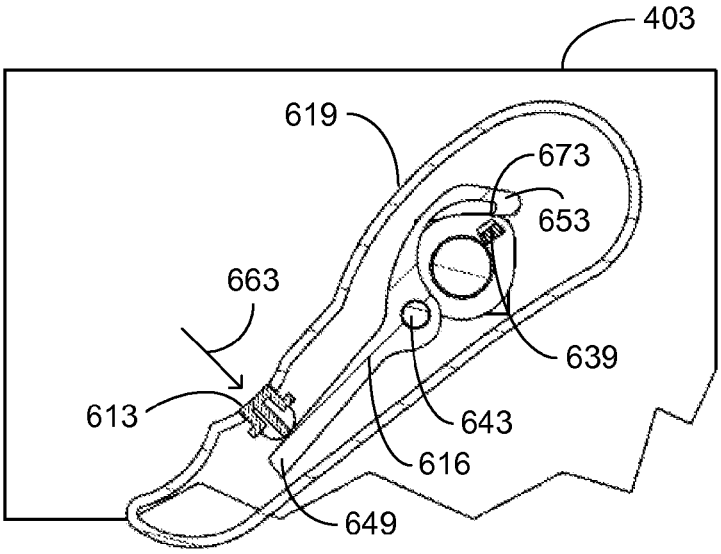

A "full flush" of the dual flush assembly 103 (FIG. 1) can be initiated by applying pressure 663 to the handle switch 613 (e.g., in the second depression) as illustrated in FIG. 6C. The "downward" pressure 663 is transferred through handle switch 613 to the proximal end 649 of the restriction arm 616, causing the restriction arm 616 to pivot about pin 643. Rotation about pin 643 moves the latching surface 673 away from the flush stop 639. Continued "downward" pressure 663 on the handle switch 613 produces rotation of the handle lever 619, which is translated through the shaft to the linage assembly 316 and piston 333 (FIGS. 3F-3G) to linear movement of cable 229 until the intermediate position is reached. When the rotary handle assembly reaches the intermediate position, the distal end 653 of the restriction arm 616 moves past the flush stop 639, as illustrated in FIG. 6D, without engaging the latching surface 673. The rotary handle assembly is then free to rotate to the full rotation position as depicted in FIG. 6E. Upon initiation of the "full flush," pressure 663 may be removed and the rotary handle assembly is allowed to return to the original neutral position of FIG. 6A with the handle switch 613 extending from the handle lever 619.

Referring next to FIGS. 7A-7E, shown are cross-sectional views of a third exemplary embodiment of a rotary handle assembly that restricts rotation during operation of the dual flush assembly 103 (FIG. 1). The handle assembly includes a handle lever 719, handle switch 713 (e.g., a button, a toggle, etc.), restriction arm 716, and cat's paw 776. The handle lever 719 includes a shaft (see, e.g., FIG. 4A) that, when assembled, extends through the center of a mounting sleeve and engages with a linkage assembly 316 (FIG. 3C) of an actuation control box 313. The mounting sleeve includes a tank shoulder 629 and an alignment element 633. The tank shoulder 629 includes a flush stop 639 to limit the rotation of the handle lever 719 during operation.

Figure 7A:
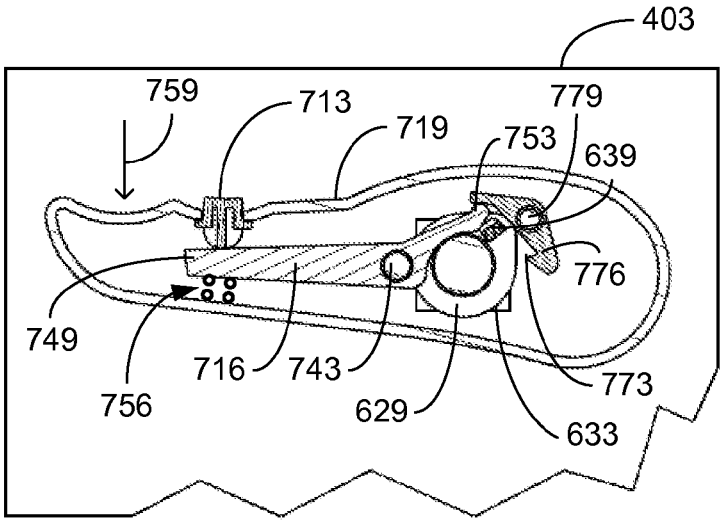
FIGS. 7A-7E are drawings that provide various views of a third embodiment of the rotary handle assembly that can be utilized in the activation assembly of FIGS. 3A-3G according to various embodiments of the disclosure.

When assembled in the handle lever 719, as illustrated in FIG. 7A, the restriction arm 716 pivots about a pin 743. In the embodiment of FIGS. 7A-7E, the handle switch 713 is a button that extends through an opening in a first or "top" surface (as oriented in FIG. 7A) of the handle lever 719 and engages with a proximal end 749 of the restriction arm 716. In some embodiments, the contact surface of the proximal end 749 of the restriction arm 716 may include an extended (or widened) surface to improve engagement with the handle switch 713. A distal end 753 of the restriction arm 716 extends around the shaft and engages a first end of the cat's paw 776. A latching surface 773 is included at the inside of a second end of the cat's paw 776. When assembled in the handle lever 719, as illustrated in FIG. 7A, the cat's paw 776 pivots about a pin 779 included in the handle lever 719.

In the embodiment of FIGS. 7A-7E, the "top" surface of handle lever 719 is contoured with a first depression at the distal end of the handle lever 719. A second depression, in the "top" surface of the handle lever 719 adjacent to the first depression, includes the opening for the handle switch 713. While not necessary for operation of the rotary handle assembly of FIGS. 7A-7E, the contour depressions aid in finger alignment on the handle lever 719 when applying force to initiate a "quick flush" or a "full flush" of the toilet.

The operation of an exemplary activation assembly 306 utilizing the rotary handle assembly of FIGS. 7A-7E is now discussed. FIGS. 7A-7E provide cross-sectional views of the rotary handle assembly mounted in a wall of a toilet tank 403. When the actuation control box 313 is in a neutral position (FIG. 3C), the handle lever 719 is in a horizontal position as depicted in FIG. 7A. In the neutral position, handle switch 713 extends from the handle lever 719. In some embodiments, a spring mechanism 756 or other appropriate means may be used to extend the handle switch 613 out from the handle lever 619. While the orientation of the activation assembly 306 including the rotary handle assembly in FIGS. 7A-7F is discussed in terms of "top" and "bottom," it is understood that variations in orientation of the activation assembly 306 are equally applicable to the present disclosure.

Figure 7B:
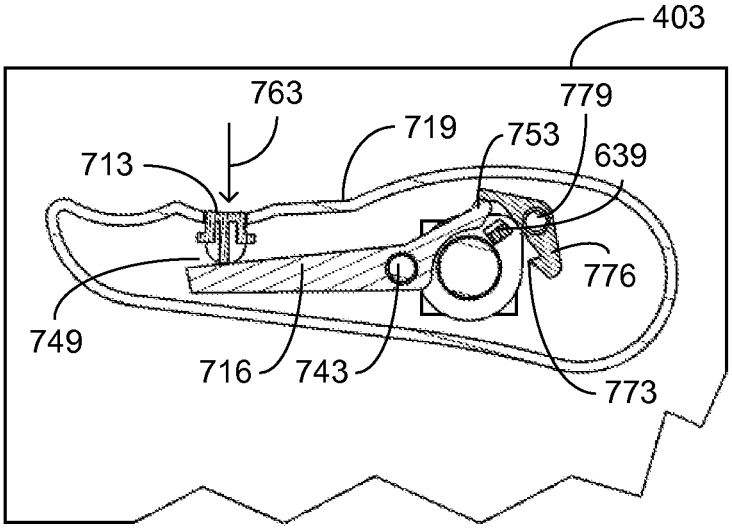
Figure 7C:
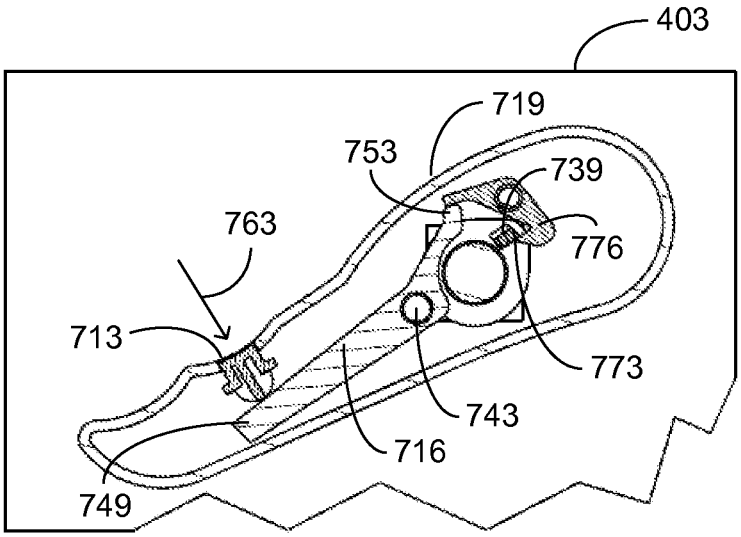

To initiate a "quick flush" of the dual flush assembly 103 (FIG. 1), pressure 763 is applied to the handle switch 713 (e.g., in the second depression) as illustrated in FIG. 7B. The "downward" pressure 763 is transferred through handle switch 713 to the proximal end 749 of the restriction arm 716, causing the restriction arm 716 to pivot about pin 743. Rotation about pin 743 lifts the first end of the cat's paw 776, causing the cat's paw 776 to pivot about pin 779 and moving the latching surface 773 towards the flush stop 739 as depicted in FIG. 7B. Continued "downward" pressure 763 on the handle switch 713 produces rotation of the handle lever 719, which is translated through the shaft to the linage assembly 316 and piston 333 (FIGS. 3F-3G) to linear movement of cable 229 until the intermediate position is reached. When the rotary handle assembly reaches the intermediate position, the latching surface 773 of the cat's paw 776 engages with the flush stop 739 as illustrated in FIG. 7C. The engagement prevents further rotation of the restriction arm 716, the cat's paw 776, and the handle lever 719. Upon initiation of the "quick flush," pressure 763 may be removed and the rotary handle assembly is allowed to return to the original neutral position of FIG. 7A.

Figure 7D:
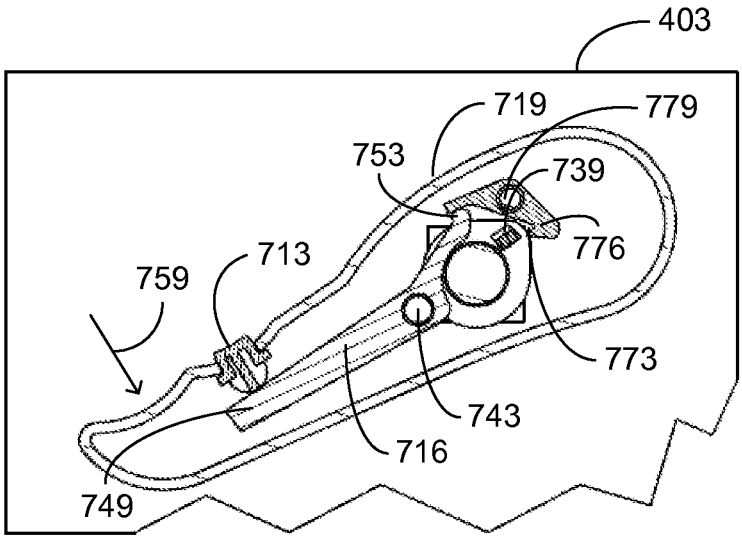
Figure 7E:
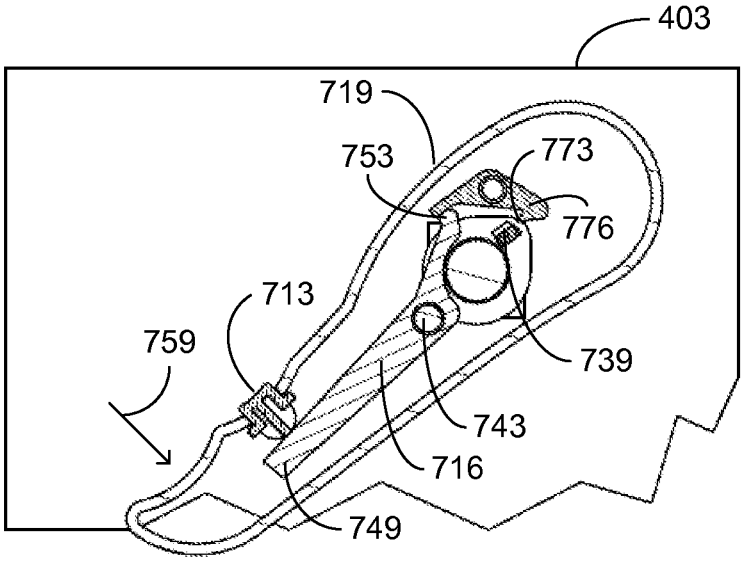

A "full flush" of the dual flush assembly 103 (FIG. 1) can be initiated by applying pressure 759 to the distal end (e.g., in the first depression) of the handle lever 719 as illustrated in FIG. 7A. The "downward" pressure 759 produces rotation of the handle lever 719, which is translated through the shaft to the linage assembly 316 and piston 333 (FIGS. 3F-3G) to linear movement of cable 229 until the intermediate position is reached. When the rotary handle assembly reaches the intermediate position, the second end of the cat's paw 776 moves past the flush stop 739, as illustrated in FIG. 7D, without engaging the latching surface 773. The rotary handle assembly is then free to rotate to the full rotation position as depicted in FIG. 7E. Upon initiation of the "full flush," pressure 759 may be removed and the rotary handle assembly is allowed to return to the original neutral position of FIG. 7A with the handle switch 713 extending from the handle lever 719.

Figure 8A:
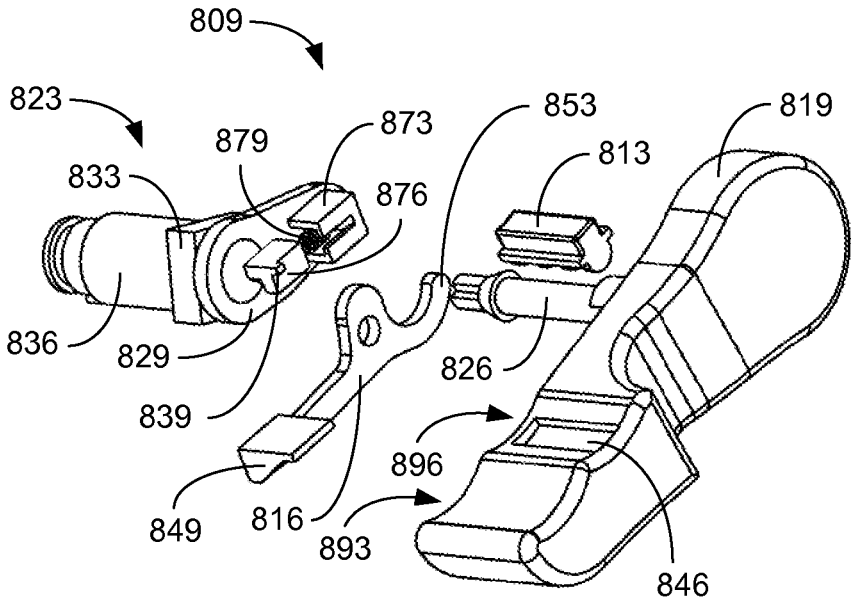
FIGS. 8A-8H are drawings that provide various views of a fourth embodiment of the rotary handle assembly that can be utilized in the activation assembly of FIGS. 3A-3G according to various embodiments of the disclosure.

Referring next to FIGS. 8A-8H, shown are views of a fourth embodiment of a rotary handle assembly 809 that restricts rotation during operation of the dual flush assembly 103 (FIG. 1). FIG. 8A provides an exploded view of the handle assembly 809, including handle lever 819, handle switch 813 (e.g., a button, a toggle, etc.), restriction arm 816, and mounting sleeve 823. Handle lever 819 includes a shaft 826 that, when assembled, extends through the center of mounting sleeve 823 and engages with a linkage assembly 316 (FIG. 3C) of an actuation control box 313.

Mounting sleeve 823 includes a tank shoulder 829, an alignment element 833, and a shaft sleeve 836. When mounting sleeve 823 is inserted through an opening in the wall of a toilet tank 403 (FIGS. 8C-8G), tank shoulder 829 engages with the outer surface of the tank 403 and alignment element 833 engages with the opening to maintain the orientation and prevent rotation of the mounting sleeve 823 within the wall of the tank 403. The tank shoulder 829 also includes a guide 873 configured to restrict movement of a rotation limiter 876 including a flush stop 839. A spring 879 within the guide 873 applies pressure to extend the rotation limiter 876 from the end of the guide 873. In some embodiments, shaft sleeve 836 may be threaded to receive a nut (not shown) or other fastener to hold the mounting sleeve 823 in position within the wall of the tank 403. The end of the mounting sleeve 823 is configured to engage with the actuation control box 313 by a spring-loaded clip assembly 329 (FIG. 3B). One or more alignment tab may be included on the end of the mounting sleeve 823 to ensure proper alignment with the actuation control box 313.

Figure 8B:
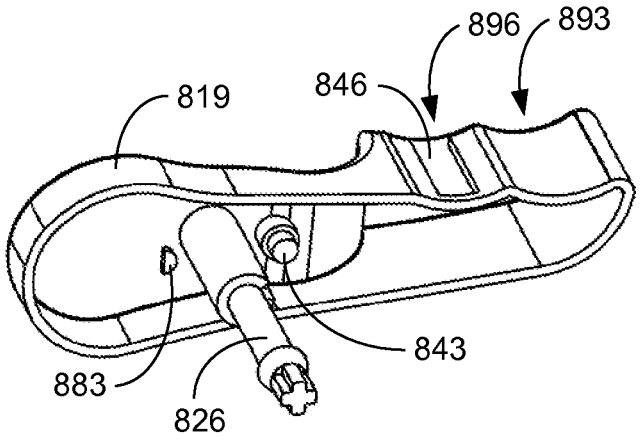
Figure 8C:
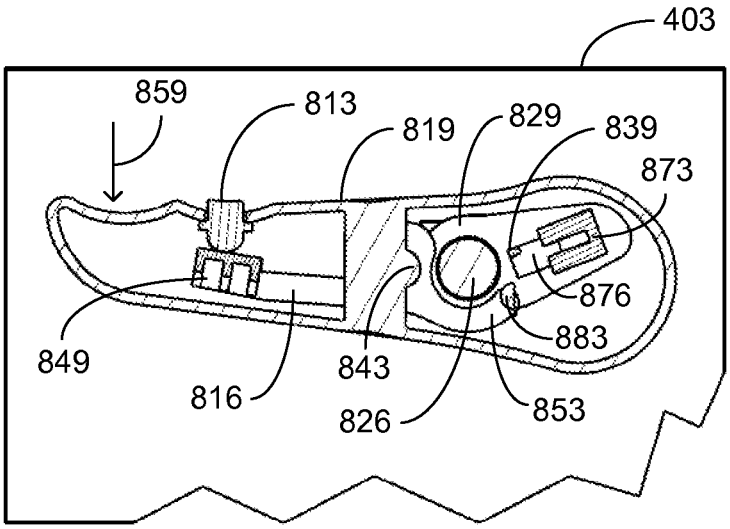

FIG. 8B is a drawing illustrating the interior of the handle lever 819. The handle lever 819 further includes a pin 843 and a rotation stop 883. When assembled in the handle lever 819, as illustrated in FIG. 8C, the restriction arm 816 pivots about the pin 843. In the embodiment of FIGS. 8A-8H, the handle switch 813 is a button that extends through an opening 846 in a first or "top" surface (as oriented in FIG. 8C) of the handle lever 819 and engages with a proximal end 849 of the restriction arm 816. In some embodiments, the contact surface of the proximal end 849 of the restriction arm 816 may include an extended (or widened) surface to improve engagement with the handle switch 813. A distal end 853 of the restriction arm 816 extends around the shaft 826.

In the embodiment of FIGS. 8A-8H, the "top" surface of handle lever 819 is contoured with a first depression 893 at the distal end of the handle lever 819. A second depression 896, in the "top" surface of the handle lever 819 adjacent to the first depression 893, includes the opening 846 for the handle switch 813. While not necessary for operation of the rotary handle assembly of FIGS. 8A-8H, the contour depressions 893 and 896 aid in finger alignment on the handle lever 819 when applying force to initiate a "quick flush" or a "full flush" of the toilet.

The operation of an exemplary activation assembly 306 utilizing the rotary handle assembly 809 is now discussed with reference next to FIGS. 8C-8G. FIGS. 8C-8G provide cross-sectional views of the rotary handle assembly 809 with the activation assembly 306 mounted in a wall of a toilet tank 403. When the actuation control box 313 is in a neutral position (FIG. 3C), the handle lever 819 is in a horizontal position as depicted in FIG. 8C. In the neutral position, handle switch 813 extends from the handle lever 819. In some embodiments, a spring mechanism or other appropriate means may be used to extend the handle switch 813 from the "top" of the handle lever 819. While the orientation of the activation assembly 306 in FIGS. 8C-8G is discussed in terms of "top" and "bottom," it is understood that variations in orientation of the activation assembly 306 are equally applicable to the present disclosure.

Figure 8D:
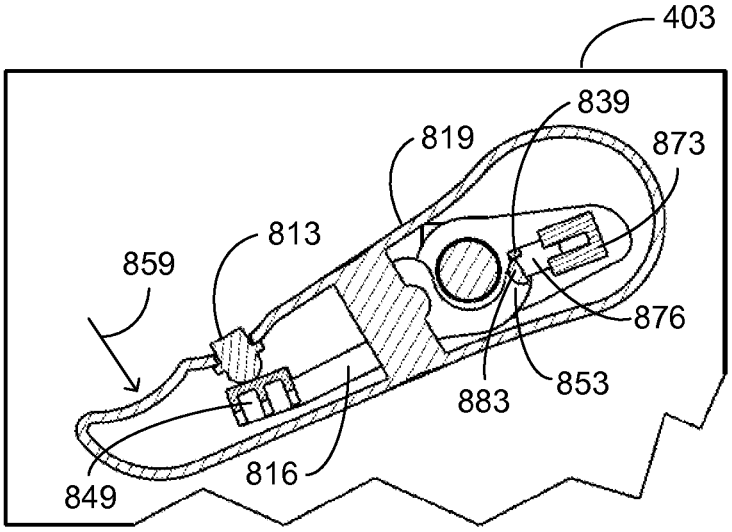

To initiate a "quick flush" of the dual flush assembly 103 (FIG. 1), pressure 859 is applied to handle lever 819 as illustrated in FIG. 8C. The "downward" pressure 859 produces rotation of the handle lever 819, which is translated from the shaft 826 through the linage assembly 316 and piston 333 (FIGS. 3F-3G) to linear movement of cable 229 until the intermediate position is reached. When the rotary handle assembly 809 reaches the intermediate position as depicted in FIG. 8D, the rotation stop 883 engages with the flush stop 839 of the rotation limiter 876 to prevent further rotation of the handle assembly 809. Upon initiation of the "quick flush," pressure 859 may be removed and the rotary handle assembly 809 is allowed to return to the original neutral position of FIG. 8C.

Figure 8E:
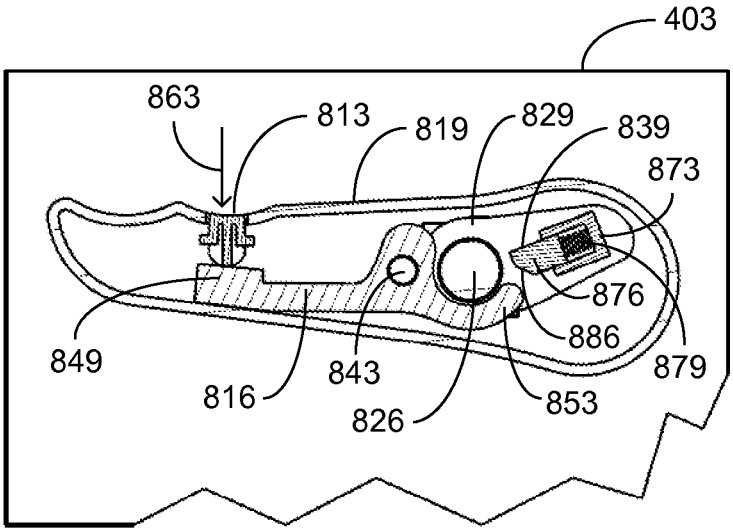
Figure 8F:
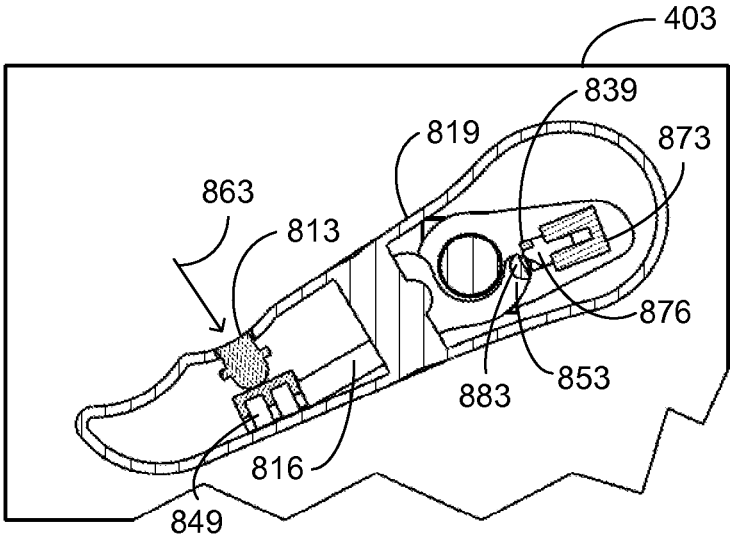
Figure 8G:
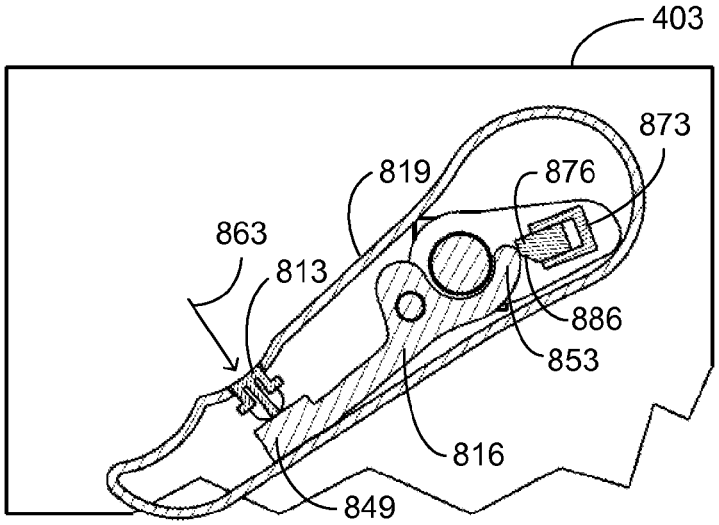
Figure 8H:
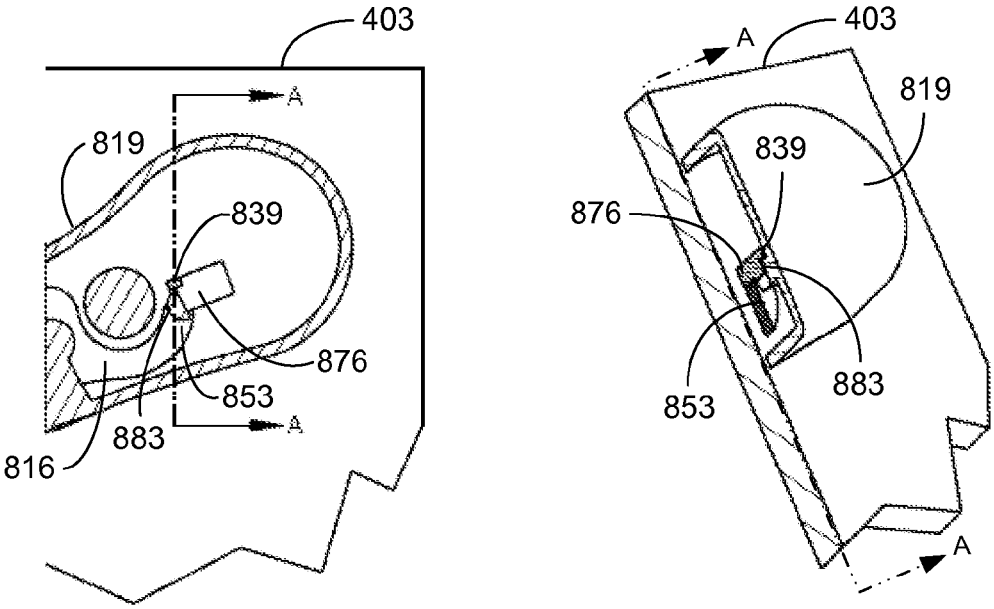

A "full flush" of the dual flush assembly 103 (FIG. 1) can be initiated by applying pressure 863 to the handle switch 813 as illustrated in FIG. 8E. The "downward" pressure 859 is also transferred through the handle lever 819 and the handle switch 813 to the proximal end 853 of the restriction arm 816, causing the restriction arm 816 to rotate about pin 843. Continued pressure 863 produces rotation of the handle lever 819, which is translated from the shaft 826 through the linage assembly 316 and piston 333 (FIGS. 3F-3G) to linear movement of cable 229 until the intermediate position is reached. When the rotary handle assembly 809 reaches the intermediate position as illustrated in FIG. 8F, the distal end 853 of the restriction arm 816 engages a tapered portion 886 of the rotation limiter 876. With the distal end 853 of the restriction arm 816 in contact with the rotation limiter 876, rotation of the handle assembly 809 presses the rotation limiter 876 into the guide 873. As depicted in FIG. 8F, retraction of the rotation limiter 876 into the guide 873 allows the rotation stop 883 to pass by the flush stop 839 without engagement. The rotary handle assembly 809 is then free to rotate to the full rotation position as depicted in FIG. 8G. FIG. 8H provides a cut away view of the rotary handle assembly 809 illustrating the relationship between the distal end of the restriction arm 816, the tapered portion 886 of the rotation limiter 876, the flush stop 839, and the rotation stop 883 of the handle lever 819. Upon initiation of the "full flush," pressure 863 may be removed and the rotary handle assembly is allowed to return to the original neutral position of FIG. 8C with the handle switch 813 extending from the handle lever 819. As the restriction arm 816 rotates away from the rotation limiter 876, the spring 879 causes the rotation limiter 876 to extend from the guide 873.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x' to about 'y'".

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A rotary handle assembly for a dual flush toilet system, comprising:
   - a flush stop;
   - a handle lever configured to rotate about an axis;
   - a handle switch configured to extend through a surface of the handle lever from an unextended position to an extended position; and
   - a restriction arm configured to engage the handle switch at a proximal end,
   - a distal end of the restriction arm configured to engage the flush stop after a first rotation about the axis when the handle switch is in the unextended position and to engage the flush stop after a second rotation about the axis when the handle switch is in the extended position.

2. The rotary handle assembly of claim 1, wherein the restriction arm is configured to engage the flush stop at the distal end to restrict rotation of the handle lever.

3. The rotary handle assembly of claim 1, wherein the handle lever further comprises a shaft extending parallel to the axis.

4. The rotary handle assembly of claim 3, wherein the shaft passes through a mounting sleeve, the shaft configured to engage with a linkage assembly of an actuation control box of the dual flush toilet system.

5. The rotary handle assembly of claim 4, wherein the mounting sleeve couples to the actuation control box via a spring-loaded clip assembly.

6. The rotary handle assembly of claim 4, wherein the mounting sleeve comprises at least one alignment tab configured to align the mounting sleeve with the actuation control box.

7. The rotary handle assembly of claim 4, wherein the mounting sleeve comprises a tank shoulder, an alignment element, and a shaft sleeve.

8. The rotary handle assembly of claim 7, wherein the mounting sleeve is inserted through an opening in a wall of a toilet tank and the tank shoulder engages an outer surface of the wall.

9. The rotary handle assembly of claim 7, wherein the flush stop is located on the tank shoulder.

10. The rotary handle assembly of claim 1, wherein the handle switch comprises a first end configured to extend outward from the handle lever and a widened surface on a second end configured to engage the proximal end of the restriction arm.

11. The rotary handle assembly of claim 1, wherein the rotary handle assembly is configured to restrict rotation of the handle lever to a first amount when the handle switch is held in the unextended position and to restrict rotation of the handle lever to a second amount otherwise.

12. The rotary handle assembly of claim 11, wherein a quick flush of the dual flush toilet system is initiated when the handle lever is rotated by the first amount and a full flush of the dual flush toilet system is initiated when the handle lever is rotated by the second amount.

13. The rotary handle assembly of claim 11, further comprising a spring configured to restore the handle lever to a neutral position.

14. The rotary handle assembly of claim 1, wherein a mounting sleeve is configured to detachably connect to an actuation control box of the dual flush toilet system, the actuation control box configured to translate a rotational motion of the handle lever to initiate a flush of the dual flush toilet system.

15. The rotary handle assembly of claim 1, wherein the handle lever further includes a pin, the restriction arm configured to pivot about the pin in response to rotation of the handle lever.

16. The rotary handle assembly of claim 1, further comprising a spring mechanism configured to retract the handle switch into the handle lever from the extended position to the unextended position.

* * * * *